United States Patent [19]

Siegmann et al.

[11] Patent Number: 4,652,866

[45] Date of Patent: Mar. 24, 1987

[54] FIRE DETECTOR AND ELECTRODE ARRANGEMENT THEREOF

[75] Inventors: Hans-Christoph Siegmann; Heinz Burtscher; Andreas Schmidt-Ott, all of Zürich, Switzerland

[73] Assignee: SLM Investissements SA, La Chaux-de-Fonds, Switzerland

[21] Appl. No.: 641,946

[22] PCT Filed: Dec. 2, 1983

[86] PCT No.: PCT/CH83/00137

§ 371 Date: Aug. 29, 1984

§ 102(e) Date: Aug. 29, 1984

[87] PCT Pub. No.: WO84/02215

PCT Pub. Date: Jun. 7, 1984

[30] Foreign Application Priority Data

Dec. 3, 1982 [CH] Switzerland ..... 7028/82

[51] Int. Cl.[4] ..... G08B 17/10

[52] U.S. Cl. ..... 340/628; 324/61 R

[58] Field of Search ..... 340/629, 628, 627; 361/306, 308; 324/61 R

[56] References Cited

U.S. PATENT DOCUMENTS

| | | | |
|---|---|---|---|
| 3,262,106 | 7/1966 | Crawford et al. | 340/629 |
| 3,949,390 | 4/1976 | Rayl et al. | 340/629 |
| 4,134,111 | 1/1979 | Nudds | 340/629 |
| 4,387,369 | 6/1983 | Klein et al. | 340/628 X |

*Primary Examiner*—James L. Rowland
*Assistant Examiner*—Jeffery A. Hofsass
*Attorney, Agent, or Firm*—Marks Murase & White

[57] ABSTRACT

The invention relates to a fire detector having a measuring chamber defined by two electrodes, so that a non-ionizing electric field is produced between the electrodes by a DC voltage source. The measuring electrode is connected to the input of a current measuring device without direct connection with the DC voltage source. As soon as charged particles of smoke penetrate into the measuring chamber between the electrodes, the electric field causes the positive and negative particles to drift. The charge drift induces a current into the measuring electrode which is measured.

28 Claims, 6 Drawing Figures

FIRE DETECTOR AND ELECTRODE ARRANGEMENT THEREOF

BACKGROUND OF THE INVENTION

The present invention relates to a fire detector with at least two electrodes between which an electric field is produced by a DC voltage source, whereby the surfaces of the electrodes which face each other define, a measuring chamber through which the air to be monitored moves by convection, one of the electrodes being arranged as a measuring electrode and the other electrode as a counter-electrode. A current measuring device and evaluating circuit is also provided.

Similar types of fire detectors are known and in use in various forms. For example, U.S. Pat. No. 2,408,051 (Donelian) shows a fire detector with two measuring chambers, wherein in the first measuring chamber particles and small ions are "filtered out" and in the second measuring chamber the air is ionized by means of a radioactive substance. The conductivity produced in this manner is reduced in the presence of smoke because ions settle onto the heavy mobile particles of smoke. When the reduction of conductivity in the ionization chamber reaches a threshold value, an alarm is released. In the above cited patent document the electrodes which define the measuring chambers are connected in series between the positive and the negative poles of a DC voltage source as a capacitive voltage divider. Moreover, relatively small field intensities of about 40 or 50 Volt/cm are provided in the first measuring chamber. The fire detector according to the above cited patent requires the use of both measuring chambers. The second measuring chamber, provided with a radioactive substance, raises environmental concerns. Moreover, the device is of a costly construction.

U.S. Pat. No. 3,754,219 (Klein) shows an apparatus for investigating the pollution of air or smoke in which the net charge is measured. However, the net charge varies so strongly in case of fire that fire detector operation based on this principle is impractical. The same concerns apply to the fire and smoke detector described in U.S. Pat. No. 3,470,551 (Jaffe et al).

Ion measuring apparatus or measuring devices for investigating the mobility of particles are also known, see for example the device described in U.S. Pat. No. 4,104,088. However, the use of such apparatus as a fire detector has not previously been proposed. Moreover, such apparatus is not for fire detection because of its construction. Most existing fire detectors comprise an ionization chamber which use radioactive substances, although there has been a long felt need for a simple fire detector that is not a burden on the environment and that operates without radioactive substances. This follows also from the article of Scheidweiler in "Staub-Reinhalt-Luft, Vol. 32, No. 11, November 1972".

SUMMARY OF THE INVENTION

Consequently, an object of the present invention is to provide an improved, highly sensitive and essentially simple fire detector and an electrode arrangement thereof, which does not use radioactive substances for ionization.

This object is achieved in accordance with the present invention in that at least one of the electrodes is provided with circulation openings for the ambient air to be monitored. A detector according to the invention preferably includes a plurality of partial electrodes with interspaces, so that ambient air may flow through the interspaces into a measuring chamber. A DC voltage source is connected between the counter-electrode and the current measuring device, and the measuring electrode is connected to the input of the current measuring device without direct connection with the DC voltage source.

The present invention uses, in an optimum and simple manner, the fact that particles of smoke produced by combustion are in principle strongly electrically charged. That charge comes from the fact that positive and negative small ions settle onto the smoke particles. In normal surroundings, the ions are constantly produced in the air, particularly by cosmic rays and natural radioactivity. The probability that a particle of radius R which is in thermodynamic equilibruiun has a charge $q=p\,e$ is given with the energy of Coulomb $p^2e^2/2R$ by the Boltzmann law. The concentration of the particles of radius R with p unit charge is therefore:

$$n_p = n_R \cdot e^{-\frac{p2e2}{2RkT}} \tag{1}$$

where $n_R$ is the total concentration of the neutral particles with radius R, k is the constant of Boltzmann and T the absolute temperature. The quadratic mean value $q^2$ is given by:

$$q^2=RkT \tag{2}$$

However, formula (2) does not take into consideration the discrete nature of the charge and it is inaccurate for particles with $R<0.1\ \mu m$ which support only a few unit charges. For the same concentration of mobile positive and negative ions, a stationary distribution of the particle's charge takes place which corresponds to the distribution of Boltzmann. The charge of an average particle is exactly zero for a Boltzmann distribution in air. In stationary air, the charge is little different from zero because the negative small ions have about a 20% higher coefficient of fixation than positive small ions.

It is already known that particles of smoke arising from combustion have a particularly strong electric charge. This is understandable in that a large concentration of small ions is present in a flame. According to the law of Boltzmann, high temperatures give rise to a high particle charge. If the smoke is dense (typically in fire: $10^7$ particles/cm$^3$) an increased charge remains for a long time before the equilibrium of Boltzmann at room temperature appears. This is because the after supply of small ions which neutralize the particles is small. Although flames create charged aerosols by different charging mechanisms, one can generally state that:

(1) each aerosol present in the environment possesses, after a long time, a Boltzmann charge distribution at the ambient temperature, and (2) dense smoke arising from a hot zone having a large concentration of ions (i.e. flame) has a charge which is greater than that described in (1) and retains its charge for a longer time.

As used herein, the expression "charge of the smoke" means the average value of the amount of charge carried by a smoke particle. A fire detector according to the present invention measures the amount of particle charge of a determined sign so that it also operates when the net charge of the smoke is zero. For such a distribution of charge, as many positive as negative ions adhere to the particles of smoke. In accordance with the invention, accurate detection of the smoke in the field between the measuring electrode and the counter-electrode is ensured through electrostatic separation of the positive and negative particles and measurement of the charge of one sign, or through measurement of the variation of conductivity caused by the smoke. The electric current produced in this manner is relatively small for field intensities which are too low to produce glow discharge but which have a value of at least on the order of 100 Volt/cm. However, this small electric current is measurable by means of electric amplifiers or small electroscopes.

The distance between the electrodes is preferably less than 10 mm but more than 1 mm. It has been found that this particular dimension gives rise to a plurality of advantages. For example, the relatively small measuring chamber causes good screening of the measuring electrode against the static induction caused by the net charge while the distance between electrodes is great enough to prevent false indications through possible deposits of particles of dust or soot. Moreover, it has been found that the above mentioned distance between the electrodes makes it possible to operate with voltages in an optimum range to provide reliable separation and precipitation of charge particles while avoiding contamination by constant attraction and deposit of particles of dust.

The present invention has the advantage of not being based on the measurement of net charge as in the known apparatus, but on the measurement of the charge after separation of the positive and negative particles.

Preferably, an auxiliary electrode arrangement is provided to pre-separate small and/or charged particles which are supported by a slow stream before they enter into the measuring chamber. This permits a reduction in sensivity with respect to small sources of smoke which give rise to small particles and/or to only a slow convective stream (e.g., cigarettes).

Attenuation of the net charge may also be achieved or further improved by providing a compensation chamber which is limited on the one hand by the measuring electrode and on the other hand by a compensation electrode. The measuring electrode is preferably screened on both sides from static induction caused by the net charge, for example in great clouds of smoke, and only the static induction in a relative small volume, limited by the measuring chamber and/or the compensation chamber, is measured. In this case the compensation electrode is preferably designed to function as a screening part of the electrode arrangement.

The above described influences on the net charge, caused by static induction may even be more fully compensated for by disposing the compensation chamber at about the same distance from the measuring electrode as the measuring chamber and dimensioning it to accept about the same volume of the stream of surrounding air. This permits compensation of static induction caused by gas which streams into the measuring chamber with a high net charge by a static induction of opposite polarity caused by gas which streams out of the compensation chamber.

Compensation is also advantageously achieved by arranging the measuring electrode with respect to the stream of air so that the stream of air comes into contact with the measuring electrode twice, the first time on one side thereof and the second time on the opposite side thereof. The stream of air flows through the electrode in order to compensate for induced currents in the measuring electrode which are caused by the net charge of the penetrating surrounding air, which may contain clouds of smoke. Through the impact of the charged smoke from different sides on the electrode, induced currents of opposite polarity are produced which cancel themselves in the electrode itself. This compensation principle may be used in accordance with the present invention when the electrode has the configuration of a closed electric circuit arranged transversely to the direction of the air stream.

The measuring and compensation electrodes for the fire detector according to the present invention are preferably designed in the form of a grid; this facilitates convection and hinders air flow, so that the gas which is in the measuring chamber loses its charge. Moreover with respect to the above described compensation principle, this ensures that by a compensation chamber and/or double streaming through the measuring electrode, simple compensation of the influences of the net charge is possible. The measuring electrode may also consist of many partial electrodes electrically connected together through which air can flow in such a manner that the influences due to the static induction caused by the net charge are compensated for in the partial electrodes.

Particularly excellent measuring results can be achieved in accordance with the present invention when the measuring electrode is arranged between two counter-electrodes, the two counter-electrodes being connected to the DC voltage source and the measuring electrode to the input of the measuring device. This permits the fields in the two measuring chambers between the two counter-electrodes and the measuring electrode to be of a symmetrical configuration with respect to the measuring electrode, which means that the measuring electrode receives charged particles of the same polarity from the two measuring chambers. This ensures particularly high sensitivity.

The measuring electrode is preferably connected to the input of the measuring device and is virtually at the potential of the other side of the measuring device. It is preferably mechanically rigidly fastened to an electrode case and/or to the counter-electrodes by means of insulating elements, the insulating elements being interrupted by electrically conductive parts which are connected to the other side of the measuring electrode. This avoids leakage currents in the insulating elements.

The technical progress and the inventive activity of the the present invention will become apparent from the various embodiments described as well as from combinations of these embodiments.

The invention will be described further by way of examples and with reference to the accompanying drawings.

DESCRIPTION OF THE PREFERRED EMBODIMENTS

Figure 1:
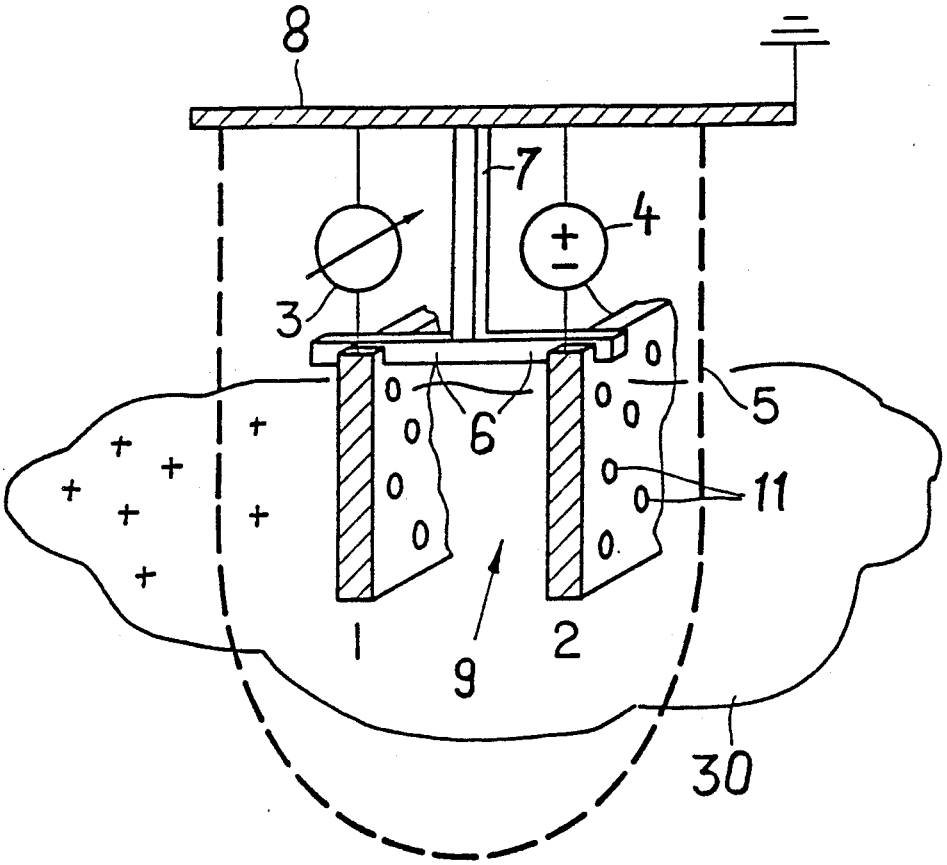
FIG. 1 illustrates the principle of a fire detector having the characteristics of the present invention.

FIG. 1 illustrates the principle of a fire detector according to the present invention with a measuring electrode 1, a counter-electrode 2, a measuring device 3 represented schematically, (the measuring device may also serve in a known manner to release an alarm), and a DC voltage source 4. The measuring electrode 1 and the counter-electrode 2 are fastened by means of insulating elements 6 to a support 7 which is connected to a base plate 8. The support 7 is electrically conductive and is connected to earth so that no leakage currents will flow on the insulation elements between the measuring electrode 1 and the counter-electrode 2. The measuring electrode is connected to earth potential—although only virtually—through the measuring device 3. This is advantageous with respect to extremely small currents. In the illustrated example, the distance between the measuring electrode 1 and the counter-electrode 2 is preferably about 5 mm, and the voltage of the DC voltage source 4 is about 500 volts, so that a field intensity of about 1000 Volt/cm is present between the electrodes 1 and 2. If charged particles of smoke enter the measuring chamber 9 between the measuring electrode 1 and the counter-electrode 2, the electric field causes the positive and negative particles to drift toward the oppositely charged electrode. This drift of charged particles (charge drift) induces a current in the measuring electrode 1 which is measured by the measuring device 3. In the illustrated embodiment the measuring electrode 1 and the counter-electrode 2 are designed in form of generally quadratic plates each having a surface area of about 40 $cm^2$. It is clear that the surface of the electrodes can be adapted to the requirements of sensitivity of the measuring device as is shown e.g. as in the embodiment according to FIG. 4. The general arrangement is surrounded by a screening element 5 which is also connected to ground. This screening element 5 provides mechanical protection for the electrodes and also prevents false static induction influences caused by the net charge of, for example, a cloud of smoke such as that schematically illustrated at 30. Influences from smoke external to the screening element 5 are kept away from the electrodes to prevent induced currents.

As illustrated schematically, the measuring electrode 1 and preferably the counter-electrode 2, are provided with a plurality of holes 11 which allow smoke to flow, by convection, in the horizontal direction with respect to the electrodes 1 and 2 as well as in the vertical direction through the measuring chamber 9.

Figure 2:
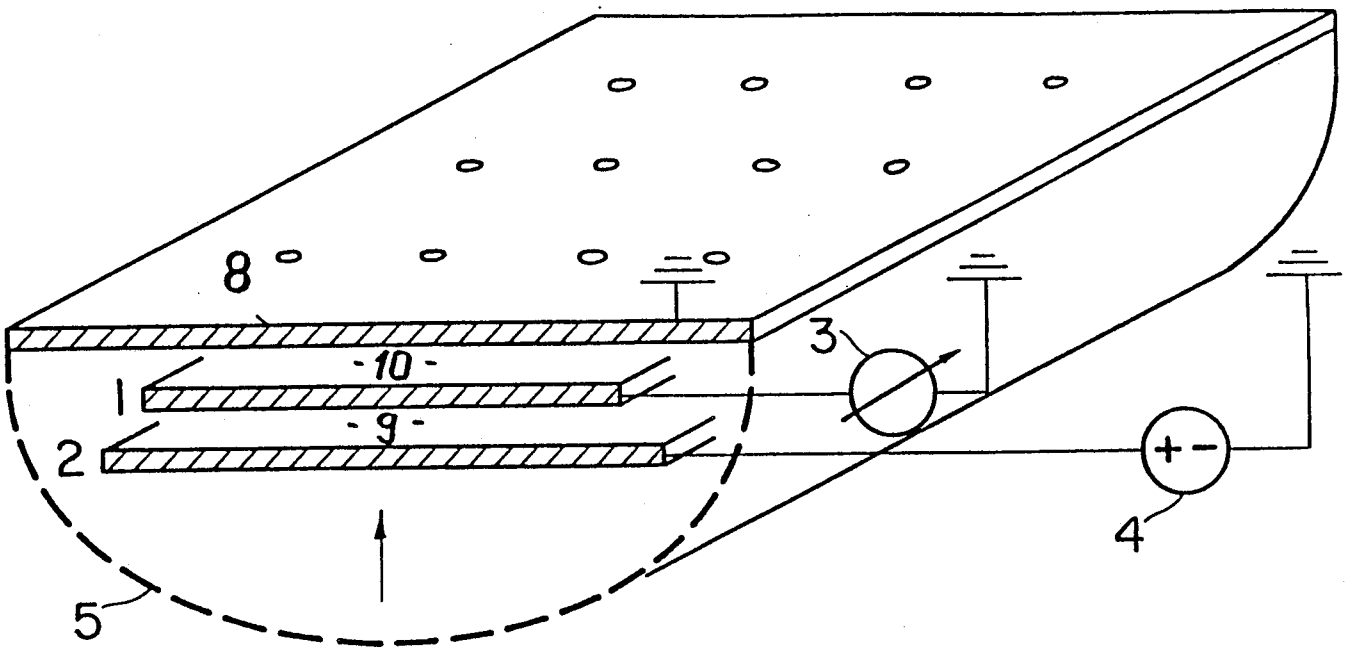
FIG. 2 shows a fire detector according to the present invention having a modified electrode.

FIG. 2 shows an arrangement in which the base plate 8 is arranged as a compensation electrode positioned parallel to and spaced at the same distance from the measuring electrode 1 as is the counter-electrode 2. The base plate 8, the measuring electrode 1 and the counter-electrode 2 are designed as punched sheets (partially not represented). Any cloud of gas having a net charge which flows through the device is screened outwards by the screening element 5. Moreover, about the same quantity of flowing gas is present in the measuring chamber 9 and in the compensation chamber 10 so that the amount of the static induction caused by the net charge is the same. However, the gas which flows into the measuring chamber 9 in the direction indicated by the arrow moves toward the measuring electrode 1 while any gas flowing in that same direction into the compensation chamber 10 moves away from the measuring electrode 1. Therefore, the resulting induced currents are of opposite polarity and cancel each other, thus compensating for the influence of any net charge in the gas cloud.

Figure 3:
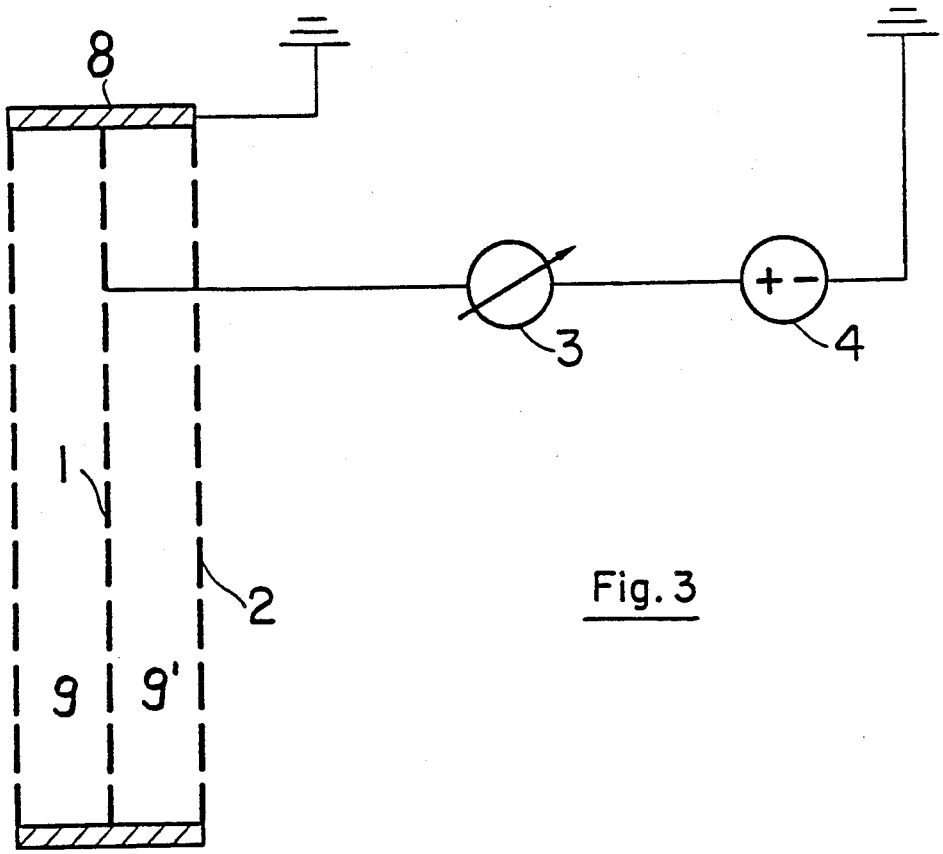
FIG. 3 shows a fire detector according to the present invention having a further modified electrode.

FIG. 3 shows an embodiment in which two counter-electrodes 2 enclose between them a measuring electrode 1, thus producing two measuring chambers 9 and 9'. The counter-electrodes 2 are designed in form of punched sheets which are connected to ground. In this embodiment, the counter-electrodes 2 also function as a screening element to screen gas from outside the detector. The measuring electrode 1 is fastened to the base plate 8 by an insulator arrangement not represented. Both counter-electrodes 2 are at the same potential with respect to the measuring electrode 1 so that the electric field distribution is symmetrical. Thus, ions of negative polarity in both the measuring chambers 9 and 9' move toward the measuring electrode 1 and the resulting induced current can be measured by the measuring device 3. The sensitivity of the device is increased due to the presence of two measuring chambers 9 and 9'. Moreover, the influences from any net charge are inherently compensated for due to the symmetry of the arrangement.

Figure 4A:
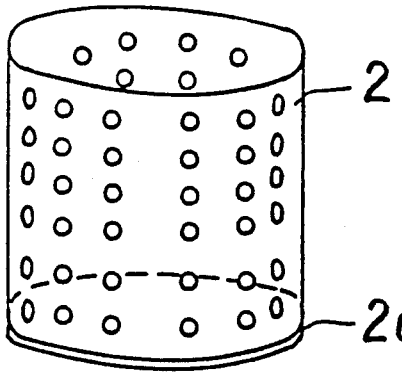
FIG. 4*a* shows a schematic perspective view of the electrodes shown in FIG. 4.
Figure 4B:
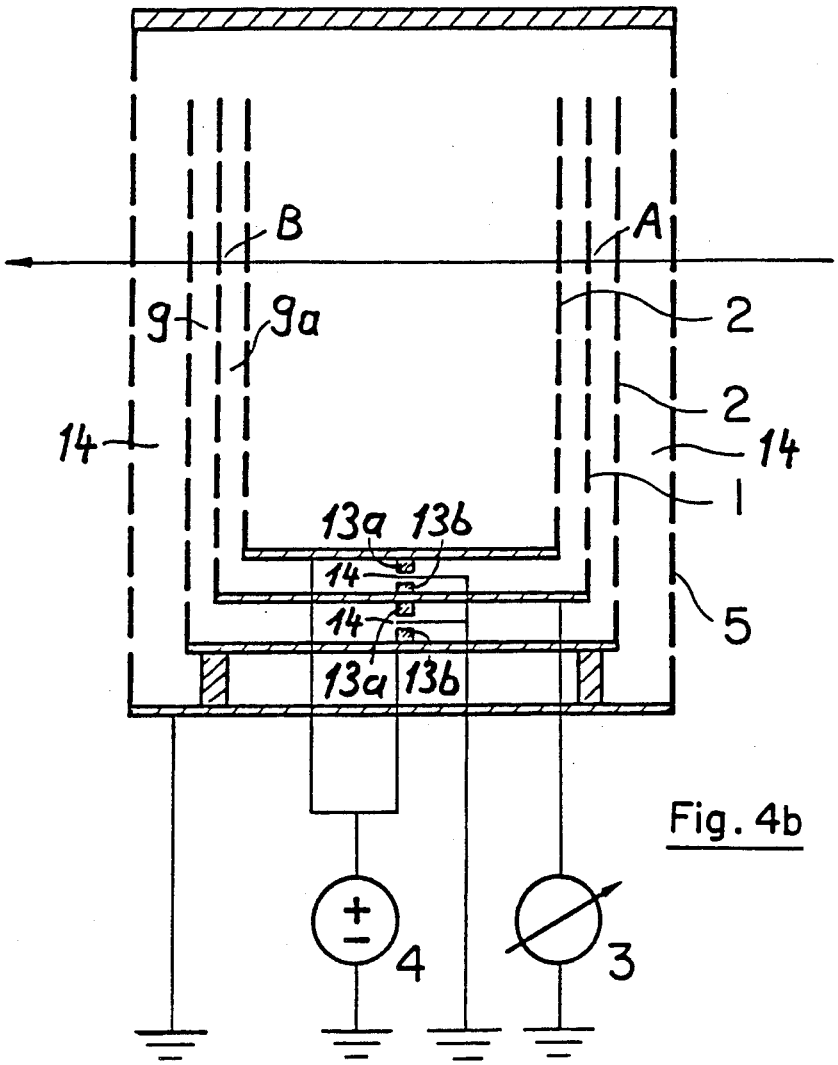
FIG. 4 shows a fire detector according to the invention having two measuring chambers and external screening.

FIGS. 4 and 4*a* show an arrangement in which the screening element 5, the measuring electrode 1 and the counter-electrodes 2 have a cylindrical symmetry. The radially external one of the two counter-electrodes 2 is fastened to the screening element 5 by means of bolts 12 constructed of soft insulating material. The measuring electrode 1 and the second counter-electrode 2 are fastened together by means of bolt-like insulating elements 13*a*, and 13*b*. Between the insulating elements 13*a* and 13*b* there is provided a metallic plate connected to ground. This avoids leakage currents between the second counter-electrode 2 and the measuring electrode 1. As best seen in FIG. 4*a*, the cylindrical counter-electrodes 2, have a floor sheet 2*a*. The cylindrical measuring electrode 1 and the cylindrical screening element 5 are similarly constructed with floor sheets. Preferably the cylindrical electrodes 1 and 2, and the cylindrical screening element 5 are all coaxially aligned with their respective floor sheets in a spaced parallel relationship.

A cloud of smoke with charged smoke particles flowing through through the device in the direction of the arrow impacts the outer surface of the measuring electrode 1 once at A and before leaving the device, again at B. Due to the fact that the measuring electrode 1 is in form of a cylinder and represents a closed electric circuit, the induced currents caused by the net charge of such a cloud of smoke are of opposite polarity and will therefore automatically cancel each other.

An electric field exists also between the screening element 5, which is also in form of a punched sheet, and the outer counter-electrode 2. The screening element 5 and the outer counter-electrode 2 define a cylindrical annular compensation chamber 14 in which the field intensity is smaller than in the two measuring chambers 9 and 9'. This reduced field intensity is a result of the distance between the screening element 5 and the outer counter-electrode 2 being greater than the distance between the measuring electrode 1 and the counter-electrodes 2. Small, slowly flowing charged particles are therefore pre-separated in the compensation chamber 14 before they enter the measuring chambers 9 and 9'. This pre-separation is selective according to the size of the particles and reduces the occurrence of false alarms.

Figure 5:
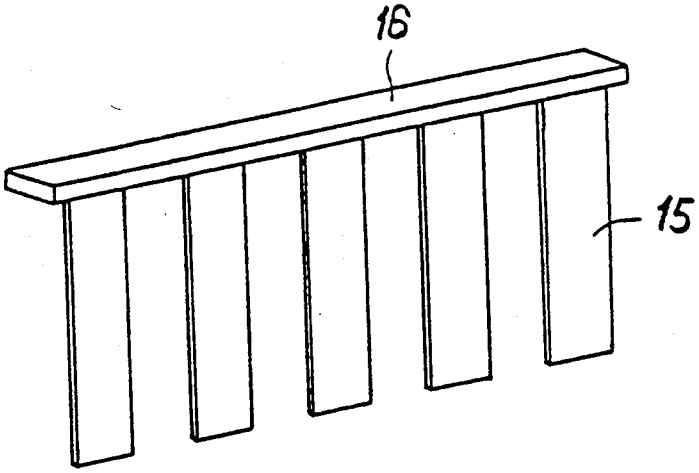
FIG. 5 shows a modified embodiment of a measuring electrode.

FIG. 5 shows an embodiment of a measuring electrode which comprises a plurality of stamped strips of sheet 15 which are connected together by means of an electrically conductive rail 16.

We claim:

1. A fire detector comprising:

a measuring electrode;

a common terminal;

at least one counter-electrode, said measuring electrode and said counter-electrode being in opposed, electrically insulated, mutually spaced relationship and defining therebetween at least one measuring chamber for flow of air therethrough;

a DC energy source connected between said counter-electrode and said common terminal for generating a non-ionizing electric field between the measuring electrode and the counter-electrode, said non-ionizing electric field being operable to electrostatically separate particles of smoke of opposite polarity; and a measuring means connected between said measuring electrode and said common terminal for instantaneously measuring current flow induced in said measuring electrode by particles of said smoke which support a charge of a predetermined polarity.

2. The fire detector as recited in claim 1 wherein at least one of said electrodes includes a means for passing air therethrough.

3. The fire detector as recited in claim 1 wherein at least one of said electrodes comprises an array of electrode elements connected to each other to form a strip, said electrode elements defining gaps therebetween for passage of air therethrough.

4. The fire detector as recited in claim 1 wherein the non-ionizing electric field between said measuring electrode and said counter-electrode has an intensity of at least about 100 volts per centimeter.

5. The fire detector as recited in claim 1 wherein said electrodes are spaced from each other by a distance in the range of approximately 1 millimeter to 10 millimeters.

6. The fire detector as recited in claim 1 further comprising an auxiliary electrode spaced from and at least partially enclosing said measuring chamber whereby air flows past said auxiliary electrode prior to entering said measuring chamber.

7. The fire detector as recited in claim 1 wherein said means for measuring current comprises an electroscope.

8. The fire detector as recited in claim 1 wherein said means for measuring current comprises an electronic amplifier.

9. The fire detector as recited in claim 1 further comprising a compensation electrode disposed in an opposed, spaced relationship with respect to said measuring electrode, said compensation and measuring electrodes defining a compensation chamber therebetween for flow of air therethrough.

10. The fire detector as recited in claim 9 wherein said compensation electrode cooperates with said measuring chamber so that air flows past said compensation electrode prior to entering said measuring chamber.

11. The fire detector as recited in claim 9 wherein said measuring electrode has first and second opposite sides, and said counter-electrode and said compensation electrode are spaced from said first and second opposite sides respectively by essentially the same distance.

12. The fire detector as recited in claim 11 wherein said measuring and compensation chambers are dimensioned to accept the same amount of flow of air therethrough.

13. The fire detector as recited in claim 11 wherein said detector has an air flowpath therethrough and said measuring electrode is disposed generally transverse with respect to said air flowpath.

14. The fire detector as recited in claim 1 wherein said measuring electrode has first and second sides and is configured to direct the flow of air to be monitored in said measuring chamber past said first side and then past said second side.

15. The fire detector according to claim 1, wherein said measuring electrode and said counter-electrode are connected by means of insulating elements, and conductive connecting means disposed between said insulating elements and said common terminal for diverting any leakage current between said measuring electrode and said counter-electrode to said common terminal.

16. The fire detector according to claim 1, wherein said D.C. Energy source constantly maintains an electric field between said measuring electrode and said counter-electrode.

17. The fire detector according to claim 1, wherein said measuring means is a low input impedance amplifier.

18. The fire detector according to claim 17, wherein said DC energy source and said low input impedance amplifier each have a first terminal connected to said common terminal and a second terminal connected to said counter-electrode and measuring electrode, respectively; and wherein said second terminals are joined by an insulating means; and wherein said insulating means is coupled via an electrically conductive support to said common terminal.

19. A fire detector comprising:

a measuring electrode having first and second sides;

a counter-electrode disposed in spaced relationship with said first side of said measuring electrode, and defining therewith a measuring chamber therebetween;

a compensation electrode disposed in spaced relationship with said second side of said measuring electrode, and defining therewith a compensation chamber therebetween;

a current measuring circuit coupled to said measuring electrode;

means for generating an electric field between said measuring electrode and counter-electrode; and means, associated with at least one of said electrodes for passing air therethrough into said measuring and compensation chambers.

20. The fire detector as recited in claim 19 wherein said means for passing air comprises passages in at least one of said electrodes.

21. The fire detector as recited in claim 19 wherein said measuring electrode is configured to direct a flow of air into said measuring chamber and then into said compensation chamber.

22. The fire detector as recited in claim 21 wherein said measuring electrode comprises an array of electrode elements connected to each other to form an electrode strip, said electrode elements having gaps therebetween for passage of air.

23. The fire detector as recited in claim 19 wherein said counter-electrode comprises first and second counter-electrodes, said first counter electrode being disposed in spaced relationship with said first side of said measuring electrode;

said second counter-electrode being disposed in spaced relationship with said second side of said measuring electrode; and said first and second counter-electrodes being coupled to said means for generating an electric field.

24. The fire detector as recited in claim 23 wherein said first and second counter electrodes are maintained at approximately the same potential with respect to said measuring electrode.

25. The fire detector as recited in claim 19 wherein said means for generating a non-ionizing electric field is a direct current voltage source, connected between said counter-electrode and said current measuring circuit.

26. The fire detector as recited in claim 19 wherein said current measuring circuit has an input coupled to said measuring electrode and an output, and wherein said measuring electrode is spaced from said counter-electrode by an insulating element having conducting portions passing therethrough, said conducting portions being coupled to said output.

27. The fire detector as recited in claim 19 wherein said measuring and counter-electrodes each comprise a closed conductor having means for passing air therethrough, and having an open end, and wherein said measuring and counter-electrodes are nested relative to each other so that said electrodes are maintained at a generally constant distance apart.

28. The fire detector as recited in claim 19 wherein said measuring and counter-electrodes each have rotational symmetry and are coaxially nested along a common axis of rotation.

* * * * *